US009038424B2

(12) United States Patent
Kwon et al.

(10) Patent No.: US 9,038,424 B2
(45) Date of Patent: May 26, 2015

(54) LAUNDRY MACHINE

(75) Inventors: Ig Geun Kwon, Changwon-si (KR); Hyun Seok Seo, Changwon-si (KR); Soo Bong Kim, Changwon-si (KR); Min Gyu Jo, Changwon-si (KR); Dong Il Lee, Changwon-si (KR); Suk Yun Moon, Changwon-si (KR); Sang Hun Kim, Changwon-si (KR); Hee Tae Lim, Changwon-si (KR); Jung Tae Song, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1000 days.

(21) Appl. No.: 13/142,662

(22) PCT Filed: Dec. 30, 2009

(86) PCT No.: PCT/KR2009/008003

§ 371 (c)(1),
(2), (4) Date: Sep. 27, 2011

(87) PCT Pub. No.: WO2010/077106

PCT Pub. Date: Jul. 8, 2010

(65) Prior Publication Data

US 2012/0017648 A1 Jan. 26, 2012

(30) Foreign Application Priority Data

| | | |
|---|---|---|
| Dec. 31, 2008 | (KR) | 10-2008-0137748 |
| May 28, 2009 | (KR) | 10-2009-0047192 |
| Aug. 27, 2009 | (KR) | 10-2009-0079829 |
| Dec. 30, 2009 | (KR) | 10-2009-0133872 |

(51) Int. Cl.

| | |
|---|---|
| ***D06F 37/22*** | (2006.01) |
| ***D06F 37/20*** | (2006.01) |
| ***D06F 37/26*** | (2006.01) |

(52) U.S. Cl.
CPC ..... *D06F 37/203* (2013.01); *D06F 37/22* (2013.01); *D06F 37/263* (2013.01)

(58) Field of Classification Search
CPC ..... D06F 37/203; D06F 37/263; D06F 37/22
USPC ..... 68/12.02, 12.06, 12.27, 23.1, 24, 140
See application file for complete search history.

(56) References Cited

U.S. PATENT DOCUMENTS

| | | | | |
|---|---|---|---|---|
| 3,854,733 | A | 12/1974 | Wilson | 277/82 |
| 6,151,930 | A * | 11/2000 | Carlson | 68/12.06 |

(Continued)

FOREIGN PATENT DOCUMENTS

| | | | |
|---|---|---|---|
| AU | 28020 77 | A | 2/1979 |
| CN | 101046046 | A | 10/2007 |

(Continued)

OTHER PUBLICATIONS

International Search Report dated Sep. 13, 2010 issued in Application No. PCT/KR2009/007967.

(Continued)

*Primary Examiner* — Joseph L Perrin
(74) *Attorney, Agent, or Firm* — Ked and Associates, LLP

(57) ABSTRACT

A washing machine for washing laundry is provided. The washing machine includes a tub to hold washing water, a drum in the tub to hold laundry, a rotational shaft connected to a rear surface of the drum, a tub back, which forms a rear side of the tub and through which the rotational shaft passes, a bearing housing that supports the rotational shaft, and a suspension that buffers and supports the bearing housing. A vibration sensor senses vibration of a structure supported by the suspension, thereby enabling control of rotation of the drum based on the sensed vibration.

8 Claims, 10 Drawing Sheets

(56) References Cited

U.S. PATENT DOCUMENTS

| | | | | |
|---|---|---|---|---|
| 6,654,975 | B2 * | 12/2003 | Broker | 8/159 |
| 2003/0101519 | A1 | 6/2003 | Gayme et al. | 8/159 |
| 2007/0017037 | A1 * | 1/2007 | Son | 8/158 |
| 2007/0039104 | A1 * | 2/2007 | Lee et al. | 8/158 |
| 2007/0227200 | A1 * | 10/2007 | Kim et al. | 68/140 |

FOREIGN PATENT DOCUMENTS

| | | | |
|---|---|---|---|
| CN | 101195954 | A | 6/2008 |
| EP | 0 414 298 | A1 | 2/1991 |
| EP | 1 079 014 | A1 | 2/2001 |
| EP | 1 094 144 | A2 | 4/2001 |
| EP | 1 433 890 | A2 | 6/2004 |
| EP | 1 433 891 | A2 | 6/2004 |
| EP | 1 605 088 | A2 | 12/2005 |
| EP | 1 619 286 | A2 | 1/2006 |
| EP | 1 746 192 | A2 | 1/2007 |
| EP | 1 857 583 | A1 | 11/2007 |
| GB | 2 174 513 | A | 11/1986 |
| JP | 2006-068273 | A | 3/2006 |
| JP | 2008-194090 | A | 8/2008 |
| WO | WO 2008/099551 | A1 | 8/2008 |
| WO | WO 2008103007 | A2 * | 8/2008 ..... D06F 37/22 |

OTHER PUBLICATIONS

International Search Report and Written Opinion dated Oct. 27, 2010 issued in Application No. PCT/KR2010/003381.

International Search Report dated Oct. 27, 2010 issued in Application No. PCT/KR2010/003382.

International Search Report and Written Opinion dated Oct. 27, 2010 issued in Application No. PCT/KR2010/003402.

International Search Report dated Nov. 24, 2010 issued in Application No. PCT/KR2010/003383.

European Search Report dated Aug. 1, 2012 issued in Application No. 09 83 6416.

PCT International Search Report dated Oct. 15, 2010 issued in Application No. PCT/KR2009/008003.

European Search Report dated Jul. 16, 2012 issued in Application No. 09 83 6427.

* cited by examiner

LAUNDRY MACHINE

TECHNICAL FIELD

The present invention relates to laundry machines, and more particularly, to a drum type washing machine a structure of which is improved for sensing vibration during operation while increasing a capacity thereof.

BACKGROUND ART

In general, the laundry machine removes various kinds of contaminants from clothes and bedding by using a softening action of detergent, friction of water flow and impacts applied to laundry caused by rotation of a pulsator or a drum. Current full automatic laundry machine carries out a series of courses of washing, rinsing, spinning, and so on automatically without intermittent handling of a user.

It is a current trend that demands for the drum type washing machine increase gradually, which, not only enables to reduce a total height, but also does not cause problems of entangling and crumpling of the laundry compared to a pulsator type laundry machine in which a washing tub rotates in an upright state.

A structure of the drum type washing machine will be described briefly. The drum type washing machine is provided with a body cabinet which forms an exterior of the drum type washing machine, a tub in the body cabinet supported by dampers and springs for holding washing water, and a cylindrical drum in the tub for placing the laundry therein, wherein the drum has driving power applied thereto by a driving unit for washing the laundry placed therein.

The drum type washing machine inevitably causes vibration due to rotation force of the drum, eccentricity of the laundry, and the like at the time the drum rotates for washing or spinning the laundry introduced to the drum, and the vibration caused by the rotation of the drum is transmitted to an outside of the drum type washing machine through the tub and the cabinet.

Consequently, in order to prevent the vibration from transmitting to the cabinet from the drum through the tub, springs and dampers are provided between the tub and the cabinet for buffering and damping the vibration of the tub, without fail.

In the meantime, the drum type washing machine is mostly installed, not independently, but in conformity with an existing installation environment (for an example, a sink environment or a built-in environment). Therefore, it is required that a size of the drum type washing machine is limited to the installation environment.

Thus, because change of an inside structure of the drum type washing machine is limited by the spring and damper which are provided for damping the vibration between the tub and the cabinet, and the installation environment of the drum type washing machine is limited, change of the size of the drum type washing machine itself is limited.

In the meantime, currently, in order to increase an amount of washing and user's convenience, many researches and developments are undergoing for increasing a washing capacity of the laundry machine. However, above limitations impose many difficulties on the increasing of the size of the tub for increasing the washing capacity in an existing drum type washing machine structure.

Consequently, a variety of structures of laundry machines are being developed for increasing the washing capacity.

DISCLOSURE

Technical Problem

To solve the problems, an object of the present invention is to provide a drum type washing machine of a new structure in which a drum supporting structure is completely different from a related art structure. In detail, a drum type washing machine of a new structure is provided in which, different from the related art, vibration of the drum transmits, not to the tub, but is buffered and supported as it is.

To solve the problems, another object of the present invention is to provide a drum type washing machine a structure of which is improved for sensing vibration during operation while increasing a capacity thereof.

Technical Solution

To achieve these objects and other advantages and in accordance with the purpose of the invention, as embodied and broadly described herein, a laundry machine includes a tub for holding washing water, a drum in the tub for holding laundry, a rotation shaft connected to a rear surface of the drum, a tubback which forms a rear side of the tub and through which the rotation shaft passes, a bearing housing for supporting the rotation shaft, and a suspension unit for buffering and supporting the bearing housing, wherein the laundry machine further includes a vibration sensor for sensing vibration of a structure supported by the suspension unit.

Preferably, the vibration sensor is mounted to the tubback.

Preferably, the tubback is fastened to the rear side of the tub with a rear gasket.

Preferably, the tubback includes a rim portion formed on an outside circumferential surface thereof and a vibration sensor mounting portion is formed on an inside of the rim portion for mounting the vibration sensor thereto.

Preferably, the rim portion further includes a water wall projected from an upper side of the vibration sensor mounting portion.

Preferably, the vibration sensor mounting portion includes a rib for supporting an upper side of the vibration sensor, and a supporting rib for supporting an underside of the vibration sensor.

Preferably, the supporting rib has a holding step for preventing the vibration sensor from falling off the vibration sensor mounting portion.

Preferably, the vibration sensor mounting portion has a plurality of space securing ribs on an inside surface of the rib for securing a mounting space of the vibration sensor.

Preferably, the vibration sensor is mounted to the suspension unit.

Preferably, the suspension unit includes weights coupled to the bearing housing and suspension brackets respectively coupled to the weights and bent to a front side of the tub, wherein the vibration sensor is mounted to the weight or one side of the suspension bracket.

Preferably, the weights and the suspension brackets are mounted symmetry with respect to the bearing housing respectively, and the vibration sensor is mounted to one of the weights or one side of the suspension bracket.

Preferably, the vibration sensor is mounted to the bearing housing.

In the meantime, the laundry machine can have the tub fixedly mounted thereto, or supported by a flexible supporting structure, like suspension units. Or, the laundry machine can be supported in an extent intermediate between the supporting by the suspension and the fixed mounting.

That is, the tub can be supported flexibly in an extent similar to the suspension unit to be described later, or rigidly more than supporting with the suspension. For an example, the tub can be supported by the suspension, or by ones, such as rubber bushings, for providing a certain extent of flexibility to the tub even though the supporting is not flexible more than the suspension.

More examples in which the tub is supported rigidly more than the suspension unit as are follows;

First, at least a portion of the tub can be formed as one unit with the cabinet.

Second, the tub can be supported connected with screws, rivets, or rubber bushings, or supported secured with welding, adhesive sealing, or the like. In this case, those connection members have rigidity greater than the suspension unit with respect to up/down directions which are a major vibration direction of the drum.

The tub can have a shape enlarged within a space the tub is mounted therein as far as possible. That is, the tub can be enlarged close to a wall or a frame (for an example, left or right side plates of the cabinet) that limits a left/right direction size of the space at least in left/right directions (a direction perpendicular to a shaft direction of a rotation shaft in a horizontal direction). The tub can be fabricated as one unit with the left or right side wall of the cabinet.

Relatively, the tub can be formed closer to the wall or the frame than the drum in the left/right directions. For an example, the tub can be formed to be spaced from the wall or the frame less than 1.5 times of a space to the drum. In a state the tub is expanded in the left/right directions thus, the drum also can be enlarged in the left/right directions. The smaller left/right direction spaces between the tub and the drum, the drum can be enlarged the more. In reducing the left/right direction spaces of the tub and the drum, left/right direction vibration of the drum can be taken into account. The smaller the left/right direction vibration of the drum, a diameter of the drum can be the greater. Therefore, the suspension unit which dampens the vibration of the drum can be made to have left/right direction rigidity greater than other direction rigidity. For an example, the suspension unit can be made to have rigidity with respect to a left/right direction deformation the greatest compared to rigidity in other directions.

Different from the related art, the suspension unit can be directly connected to the bearing housing which supports the rotation shaft connected to the drum, without passed through the tub. That is, the bearing housing can include a supporting portion for supporting the rotation shaft and an extension extended therefrom, and the suspension unit can be fastened to the supporting portion or the extension of the bearing housing.

In this instance, the suspension unit can include a bracket extended in a shaft direction of the rotation shaft. And, the bracket can be extended forward toward the door.

In the meantime, the suspension unit can include at least two suspensions spaced in an axis direction of the rotation shaft.

The suspension unit can include a plurality of suspensions which are mounted under the rotation shaft for standably supporting an object of supporting (for an example, the drum). Or, the suspension unit can include a plurality of suspensions which are mounted over the rotation shaft for suspendably supporting an object of supporting. Those cases are of types in which the suspensions are provided only under or over the rotation shaft for supporting.

A center of gravity of a vibrating body including the drum, the rotation shaft, the bearing housing, and the motor can be positioned on a side where the motor is with reference to at least a length direction geometric center of the drum.

One of the suspensions can be positioned in front or rear of the center of gravity. Moreover, the suspensions can be mounted in front and rear of the center of gravity, respectively.

The tub can have a rear opening. A driving unit including the rotation shaft, the bearing housing, and the motor can be connected to the tub through a flexible member. The flexible member can be made to seal such that water does not leak through the rear opening of the tub, and to enable the driving unit to move relative to the tub. The flexible member may be of any material as far as the material can function as a sealing and is flexible, for an example, flexible member may be formed of a gasket material like the front gasket. In this case, for convenience sake, the flexible member may be called as a rear gasket with reference to the front gasket. The rear gasket can be connected to the driving unit in a state the rear gasket is limited not to rotate at least in a rotation direction of the rotation shaft.

As an embodiment, the rear gasket can be connected to the rotation shaft directly, or to the extension of the bearing.

A portion of the driving unit positioned in front of a connection portion to the rear gasket so as to be vulnerable to exposure to the washing water in the tub can be made to be prevented from corrosion by the washing water. For an example, the portion may be coated, or a front surface thereof may be covered with an additional component (for an example, a tubback described later) of plastic. Parts of the driving unit formed of metal can be prevented from corrosion by preventing the parts from direct exposure to the water.

Along with this, different from the embodiment, the cabinet may not be included to the laundry machine. For an example, in a case of a built-in laundry machine, a space the laundry machine is to be installed therein may be provided, not by the cabinet, but by a wall structure. That is, the laundry machine can be fabricated in a shape which does not include the cabinet which forms an exterior, independently. However, in this case too, the front frame can be required for a front exterior.

Advantageous Effects

The present invention has following advantageous effects.

The laundry machine of the present invention can provide a drum type washing machine of a drum supporting structure completely different from the related art. Vibration does not transmit from the drum to the tub, and buffered effectively.

As a structure of the washing machine is improved to increase a capacity thereof and sense vibration thereof during operation, it can be made that no heavy vibration can take place by controlling rotation of the drum according to the vibration sensed thus.

BEST MODE

Reference will now be made in detail to the specific embodiments of the present invention, examples of which are illustrated in the accompanying drawings.

In describing the present invention, names of elements are defined taking functions thereof into account. Therefore, it is required to understand that the names do not limit the elements technically. Moreover, the names of the elements may be called differently in this field of art.

Figure 1:
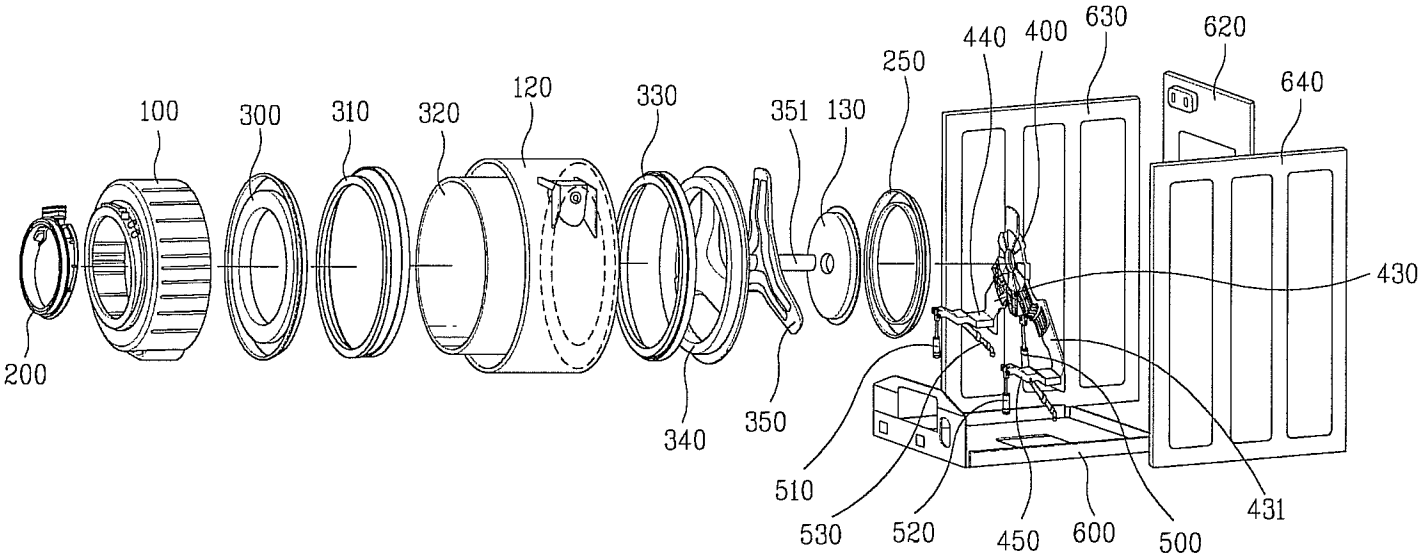
FIG. 1 illustrates an exploded perspective view of a laundry machine in accordance with a preferred embodiment of the present invention.

FIG. 1 illustrates an exploded perspective view of a laundry machine in accordance with a preferred embodiment of the present invention.

Referring to FIG. 1, the laundry machine has a tub fixedly secured to a cabinet. The tub includes a tubfront 100 which forms a front portion thereof and a tubrear 120 which forms a rear portion thereof. The tubfront 100 and the tubrear 120 are fastened together with screws for forming a space for placing a drum therein. The tub also includes a tubback 130 which forms a rear surface thereof. The tubback 130 is connected to the tubrear 120 with a rear gasket 250. The rear gasket 250 is formed of elastic material for preventing vibration from transmitting to the tubrear 120 from the tubback 130.

The tubrear 120 has a rear surface 128. The rear surface 128 of the tubrear 120, the tubback 130, and the rear gasket 250 form a rear wall surface of the tub. The rear gasket 250 is sealably connected to the tubback 130 and the tubrear 120 respectively for preventing the washing water from leaking from the tub. The tubback 130 vibrates together with the drum when the drum rotates. In order to prevent the tubback 130 from interfering with the tubrear 120 at the time the tubback 130 vibrates, the tubback 130 is spaced from the tubrear 120, adequately. Since the rear gasket 250 is formed of elastic material, the rear gasket 250 allows the tubback 130 to make relative motion without interference with the tubrear 120. The rear gasket 250 may have a corrugated portion 252 (See FIG. 4) which can be extended adequately for allowing the relative motion of the tubback 130.

A foreign matter getting in preventive member 200 is connected to a front of the tubfront 100 for preventing foreign matters from entering between the tub and the drum. The foreign matter getting in preventive member 200 is formed of an elastic material, and fixedly mounted to the tubfront 100. The foreign matter getting in preventive member 200 may be formed of a material the same with the rear gasket 250.

The drum includes a drumfront 300, a drumcenter 320, and a drumback 340. Ball balancers 310 and 330 are mounted to a front portion and a rear portion of the drum, respectively. The drumback 340 is connected to a spider 350, and the spider 350 is connected to a rotation shaft 351.

The rotation shaft 351 is passed through the tubback 130 and connected to the motor, directly. In detail, a rotor of the motor and the rotation shaft 351 are connected, directly. There is a bearing housing 400 coupled to the rear surface 128 of the tubback 130. The bearing housing 400 rotatably supports the rotation shaft 351 between the motor and the tubback 130.

A stator is fixedly mounted to the bearing housing 400. The rotor is positioned around the stator. As described before, the rotor is directly connected to the rotation shaft 351. The motor, being an outer rotor type motor, is connected to the rotation shaft 351, directly.

The bearing housing 400 is supported on a cabinet base 600 through a suspension unit. The suspension unit includes three vertical suspensions and two tilted suspensions for supporting in front/rear directions in tilted positions. The suspension unit is connected to the cabinet base 600, not fixedly perfectly, but to allow a certain extent of elastic deformation to allow the drum to move in front/rear and left/right directions.

That is, the suspension unit is elastically secured to allow a certain extent of rotation of the suspension unit in front/rear and left/right directions with respect to a securing point at which the suspension unit is connected to the base. In order to make such elastic securing, the vertical suspensions may be mounted to the base 600 with rubber bushings disposed therebetween, respectively. Of the suspensions, it can be configured that the vertical suspensions elastically buffer vibration or the drum, and the tilted suspensions dampens the vibration. That is, it can be configured that, of a vibration system having springs and damping means, ones mounted in vertical positions serve as a spring and ones mounted in tilted positions serve as damping means.

The tub is fixedly mounted to the cabinet except the tubback 130, and the vibration of the drum is buffered and supported by the suspension unit. It can be said that supporting structures for the tub and the drum are separated from each other actually, such that the tub does not vibrate even if the drum vibrates.

Respective parts will be described in detail.

Figure 2:
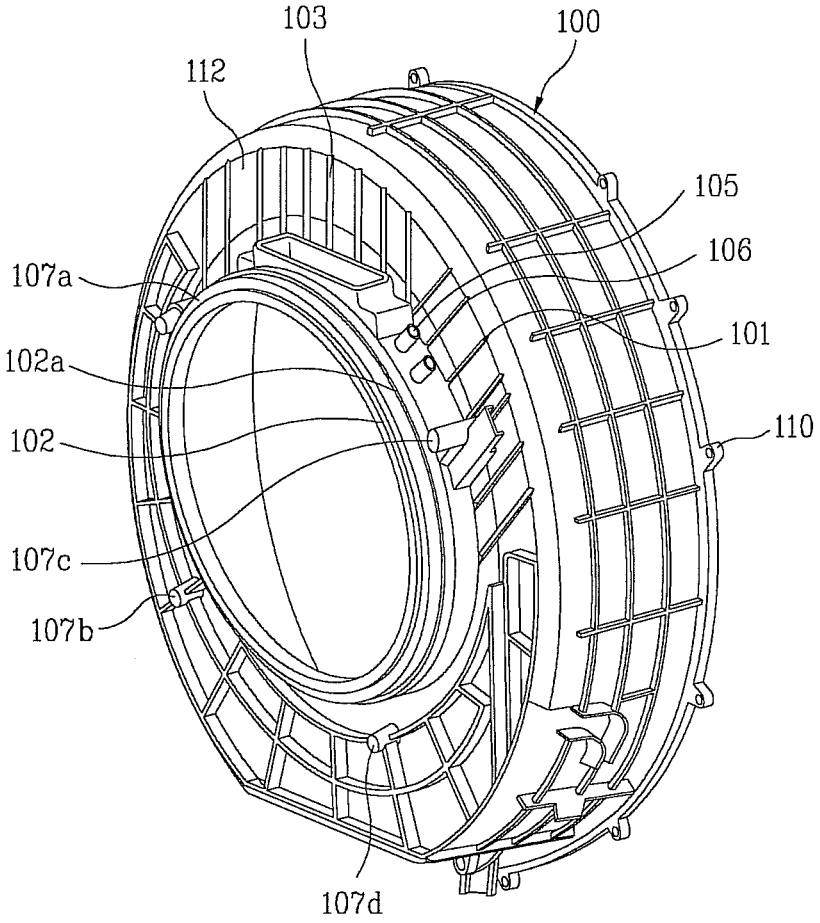
FIGS. 2 and 3 illustrate perspective views of tubfronts of a laundry machine in accordance with a preferred embodiment of the present invention, respectively.
Figure 3:
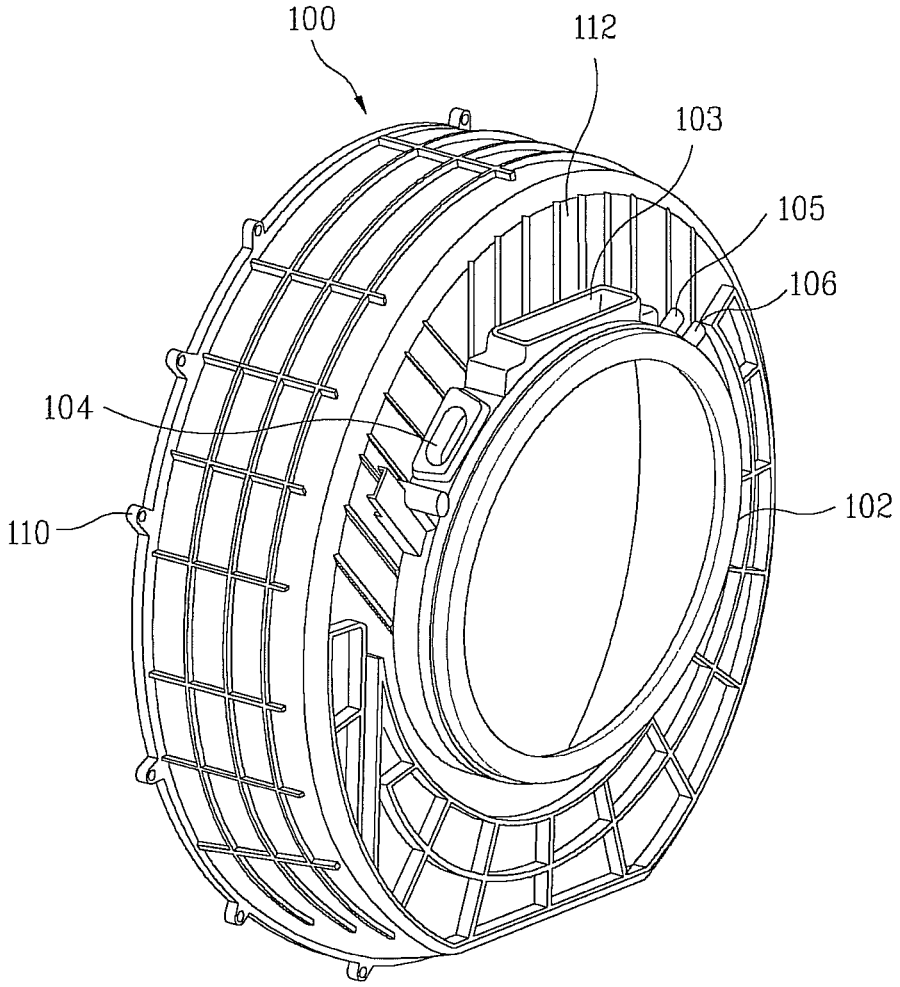

FIGS. 2 and 3 disclose the tubfront 100. The tubfront 100 has a donut shaped vertical front surface at a front side of a cylindrical surface which is a portion of a sidewall of the tub. A rear side of the cylindrical surface is opened, and has a plurality of fastening holes 110. The fastening holes 110 are fastened to fastening holes 127 (See FIG. 4) in the tubrear 120 matched thereto, respectively.

A rim portion 101 is extended forward from an inside circumferential surface of a front surface of the tubfront 100. The rim portion 101 has a width which becomes the smaller at the rim portion 101 goes from an upper side to a lower side the more. At a lower side of a lower edge of the front surface, there may not be the rim portion 101 formed thereon, actually.

The rim portion 101 has a water supply hole 104, a hot air inlet 103 to be used for drying, a circulating water inlet 106 for inlet of washing water circulated by a circulating pump, and a steam inlet 105 for introduction of steam.

Since the laundry machine of the present invention has vibration of the tub reduced significantly, connection of a water supply structure, such as the water supply hose for supplying washing water, a structure for drying, such as drying duct, a structure for supplying steam, a structure for supplying the circulating water, and so on can be held in position, securely.

The hot air inlet 103 is an upward rectangular shaped extension from the rim portion 101, substantially. The hot air inlet 103 is required for a washing and drying machine, and may not be required for a washing machine which has no drying function.

Since the water supply hole 104 and so on are formed in the front portion of the tubfront 100, supply of the washing water and so on are made at the front side of the tub.

The water supply hole 104 and so on can be positioned in front of a front end of the drum which is housed in the tub. Accordingly, the washing water and so on can be introduced to the drum directly through a drum opening provided for laundry in/out. Since fluids which are supplied for treating the laundry, such as the washing water and so on, can be introduced to the drum directly, effective treatment of the laundry is possible. Moreover, in a case detergent is supplied together with the washing water which is supplied through detergent box, if the detergent is introduced to the drum directly, consumption of the detergent can be reduced, enabling to reduce an amount of the washing water, accordingly. And, a problem of contamination of a bottom of the tub by deposition of detergent sediments can be reduced. Furthermore, the water supply from the front of the tub can have an effect of washing door glass (not shown).

Even if the hot air is supplied from the front of the tub, if the hot air is supplied through a vertical surface of the tubfront 100, since a flow of the hot air undergoes two times of bending to form a shape (a shaped complicate flow is formed as the hot air introduced into the tub is bent downward at a front of the tub and bent forward of the tub again), the flow of the hot air can be poor. However, if the hot air inlet 103 is formed in the rim portion 101 of the tubfront 100, the flow of the hot air can be smooth since the hot air flow is required to bend only one vertically.

The water supply holes 104 and so on are positioned above a center point of the drum. The washing water and so on are supplied to the drum from an upper side of the front of the drum. If, different from this, it is required to supply the washing water and so on to the drum from a lower side of the front of the drum, the rim portion 101 of the tubfront 100 can be formed at the lower side of the front surface, accordingly. If it is required to supply the washing water and so on to the drum, not from the upper or lower side, but from a left or right side of the front of the drum, the rim portion 101 of the tubfront 100 can be formed in the vicinity of a center portion 131 of an inside edge of the front surface, accordingly. That is, a shape of the rim portion 101 can vary with a direction of supply of the fluids.

In a front edge of the rim portion 101, there is a coupling portion 102 for coupling the foreign matter getting in preventive member 200 thereto. The coupling portion 102 is a forward extension from a front end of the rim portion 101 to form a small cylindrical surface, substantially. The small cylindrical surface has a rib 102*a* formed on an outside circumferential surface.

The foreign matter getting in preventive member 200 is coupled to the coupling portion 102 as the coupling portion 102 is placed in the foreign matter getting in preventive member 200. Accordingly, the foreign matter getting in preventive member 200 has a groove (not shown) for placing the small cylindrical surface having the rib 102*a* therein.

The tubfront 100 is fixedly connected to the cabinet front (not shown). For this fixed connection of the tubfront 100, fastening bosses 107*a*, 107*b*, 107*c* and 107*d* are formed on the front surface of the tubfront 100 to surround the rim portion 101, substantially. After positioning the cabinet front (not shown) in a state the tubfront 100 is mounted, the cabinet front (not shown) is fastened to the tubfront 100 by fastening screws in a rear direction.

The steam inlet 105 can be connected to a steam hose. The steam inlet 105 has a steam guide 105*a* for guiding the steam introduced thereto to an inside of the drum. The circulating water inlet 106 has a circulating water guide 106*a* for guiding the circulating water introduced to the circulating water inlet 106 to the inside of the drum. The steam inlet 105, the circulating water inlet 106, the steam guide 105*a* and the circulating water guide 106*a* are formed as one unit with the tubfront 100. The tubfront 100 of plastic is injection molded together with the steam inlet 105 and so on as portions of the tubfront 100.

The tubfront 100 is coupled to the tubrear 120 to form a space for housing the drum. The tubfront 100 and the tubrear 120 are fastened with screws. For this screw fastening, the tubfront 100 has a plurality of screw fastening holes 110 formed along a circumference of a rear portion thereof.

Figure 4:
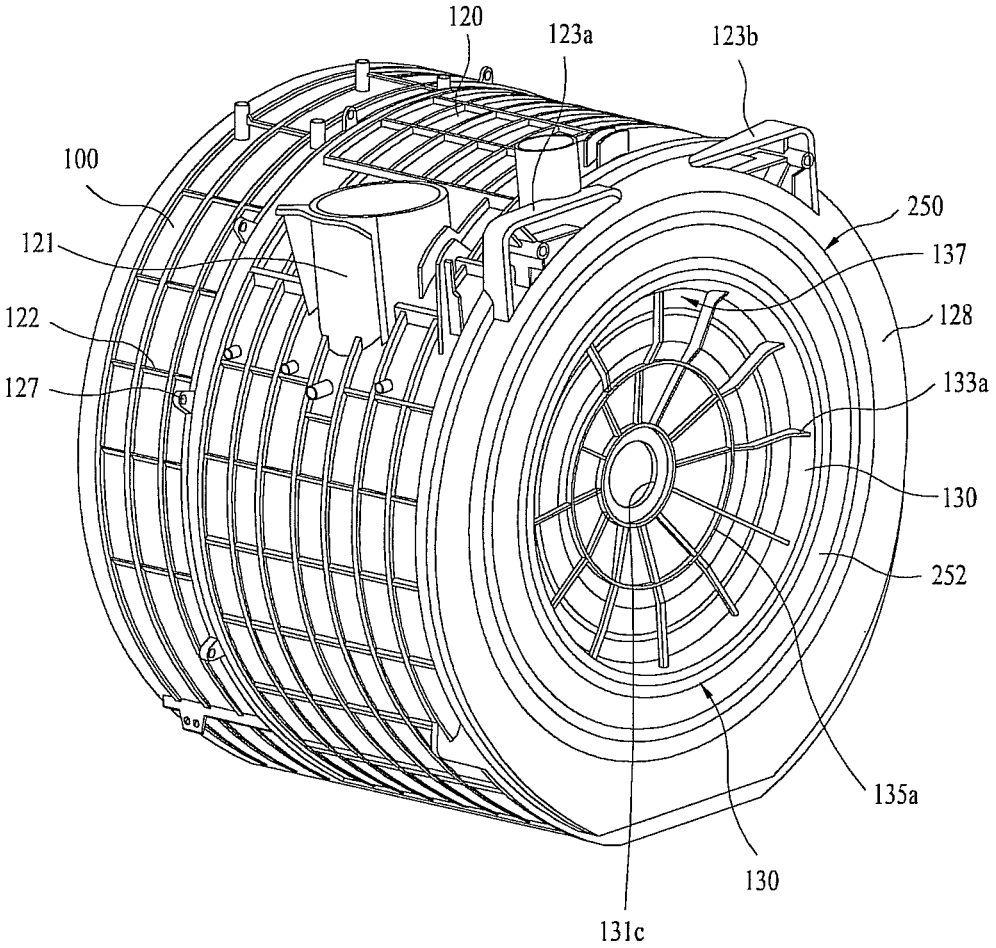
FIG. 4 illustrate a rear perspective view of a tubrear of a laundry machine in accordance with a preferred embodiment of the present invention.

FIG. 4 illustrates the tubfront 100, the tubrear 120, the tubback 130, and the rear gasket 250 assembled together.

The tubrear 120 is cylindrical to surround the drum, and has an opened front and the donut shaped rear surface 128. The front is sealably coupled to the tubfront 100. The rear surface 128 of the tubrear 120 has a diameter adequately greater than the outside diameter of the tubback 130, so that a gap enough to prevent the tubback 130 from interfering with the rear surface 128 of the tubrear 120 even if the tubback 130 vibrates. In the gap, i.e., between the rear surface 128 of the tubrear 120 and the tubback 130, there is the rear gasket 250 connected. The rear gasket 250 seals between the rear surface 128 of the tubrear 120 and the tubback 130. The rear gasket 250 has a corrugated portion 252 having an adequate elasticity for not interfering with the vibration of the tubback 130.

The tubrear 120 has a hot air outlet 121 on one side for the washing and drying machine. It is natural that the hot air outlet 121 is not required if the laundry machine is not the washing and drying machine, but a washing machine only for washing.

In the meantime, under the tubfront 100 and the tubrear 120, there is an additional structure for fixedly securing the tub.

The tubback 130 has a pass through hole 131*c* formed at a center for passing the rotation shaft 351 to rotate the drum. On an outer side of the pass through hole 131*c*, there are a plurality of radial direction ribs 133*a* projected in a radial direction and circumferential direction for reinforcing the tubback 130. Along a circumferential direction of the radial direction ribs 133*a*, there are a plurality of fastening bosses 135*a* for fastening the bearing housing 400 thereto. In the meantime, mounted to an upper side of the tubback 130, there is a vibration sensor 191 for sensing vibration of the tubback 130. The vibration sensor 191 and a structure for mounting the vibration sensor 191 will be described later. (See FIG. 8).

In the meantime, the tubback 130 is elastically coupled to a rear side of the tubrear 120 with an additional rear gasket 250. The bearing housing 400 is fastened to a rear of the tubback 130 with additional fastening bodies (for an example, bolts). The rotation shaft 351 passes through the center of the tubback 130 and fixed to the spider 350 of the drum in a state the rotation shaft 351 is supported on the bearing housing 400.

The rotation shaft 351 connected to the spider 350 rotates the drum through the spider 350. The tubback 130 is positioned with a fixed distance to the drum or the spider 350. The motor is positioned at the bearing housing 400. The bearing housing 400 has bearings 404 provided therein for rotatably supporting the rotation shaft.

In this instance, the spider 350, the rotation shaft 451 and the rotor of the motor are configured to rotate, and the bearing housing 400 and the tubback 130 are configured not to rotate. Accordingly, the rotation shaft rotates passed through the tubback 130 and the bearing housing 400 that are immovable. Since a front side of the tubback 130 is a portion for holding water for washing, it is very important to prevent the water from leaking to a rear side of the tubback 130 through the rotation shaft 351.

Figure 5:
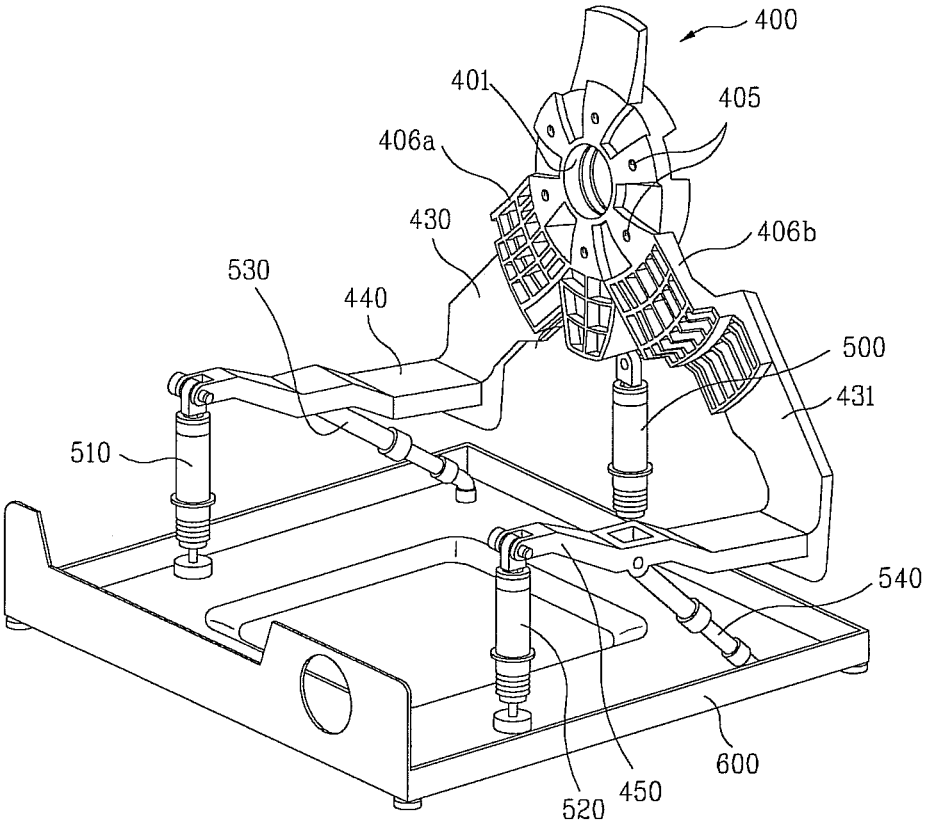
FIG. 5 illustrates a suspension of a laundry machine in accordance with a preferred embodiment of the present invention.
Figure 6:
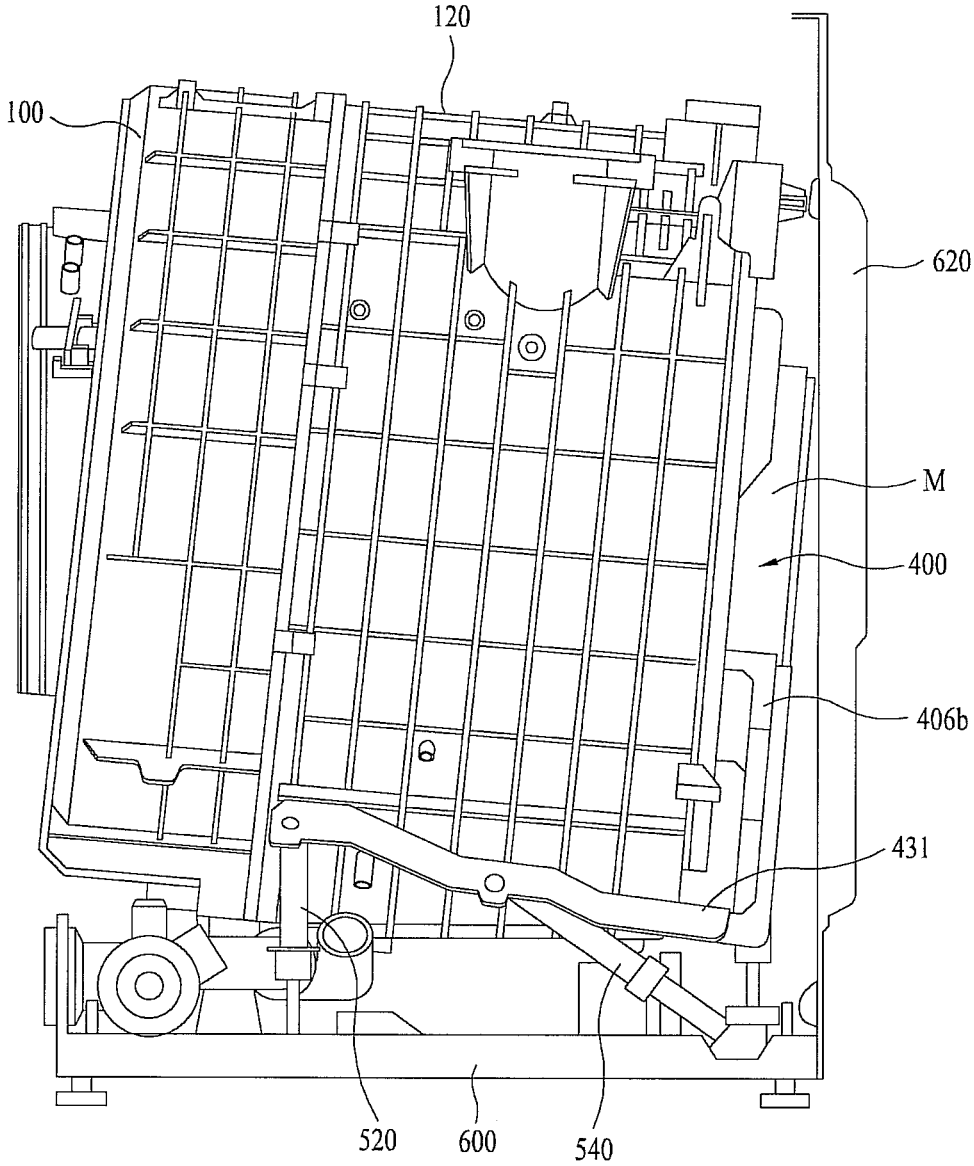
FIG. 6 illustrates a side view of an assembly of a tub and a suspension of a laundry machine in accordance with a preferred embodiment of the present invention.

FIG. 5 illustrates the suspension unit mounted on the base 600. FIG. 6 illustrates assembly of the tub 100 and 120, the bearing housing 400, and the suspension unit.

The suspension unit includes the bearing housing 400, a first weight 431, a second weight 430, a first suspension bracket 450, and a second suspension bracket 440.

The bearing housing 400 has a rotation shaft hole 401 at a center for passing the rotation shaft 351. The rotation shaft hole 401 have one pair of bearings 404 placed in a front end and a rear end thereof, respectively. The rotation shaft 351 is rotatably supported by the bearings 404.

The rotation shaft hole 401 has a seating surface 401*a* at an outside circumferential surface for seating a water seal (not shown). The rotation shaft hole 401 has a plurality of tubback fastening holes 405 formed around the rotation shaft hole 401 matched to the pass through holes in the tubback 130. In rear of the bearing housing 400, there is a motor mounting portion (not shown).

The bearing housing 400 is coupled to the tubback 130 with additional fastening bodies which pass through the pass through holes 405. Between the bearing housing 400 and the tubback 130 coupled thus, there is a water seal for maintaining sealing between the bearing housing 400 and the tubback.

Extended in a radial direction of left and right directions from the bearing housing 400, there are a first extension 406*a* and a second extension 406*b*. The first extension 406*a* and the second extension 406*b* have the first weight 431 and the second weight 430 connected thereto, respectively. The first weight 431 and the second weight 430 have the first suspension bracket 450 and the second suspension bracket 440 connected thereto, respectively.

The first extension 406*a* and the second extension 406*b*, the first weight 431 and the second weight 430, and the first suspension bracket 450 and the second suspension bracket 440 are symmetry to each other, respectively. The first and second weights 431 and 430 serve as balancer in a case the drum holds laundry, and mass in a vibration system in which the drum vibrates.

The suspension unit can include vertical suspensions for buffering in a vertical direction and front/rear direction suspensions for buffering in front/rear directions. One of the vertical suspensions can be arranged on a rear side of the base, and two of the vertical suspensions can be arranged on a front side of the base on left and right sides of a center of the base, respectively. Two suspensions can be arranged on left and right sides tilted in a front/rear direction.

The suspension unit can include a first cylinder spring 520, a second cylinder spring 510, a third cylinder spring 500, a first cylinder damper 540, and a second cylinder damper 530.

The cylinder spring is mounted between a cylinder and a piston. Owing to the cylinder and the piston, a length of the cylinder spring makes stable variation at the time of buffering. The cylinder is connected to the suspension bracket and the piston is connected to the base. A cylinder damper provides a damping effect as the piston moves in the cylinder.

The first cylinder spring 520 is connected between the first suspension bracket 450 and the base 600. The second cylinder spring 510 is connected between the second suspension bracket 440 and the base 600. The third cylinder spring 500 is connected between the bearing housing 400 and the base 600, directly. The cylinder springs buffer and support at one point on the rear side and two points on the left and right sides of the front side.

The first cylinder damper 540 is mounted tilted between the first suspension bracket 450 and the rear side of the base, and the second cylinder damper 530 is mounted tilted between the second suspension bracket 440 and the rear side of the base.

The third cylinder spring 500 is arranged at a center of the rear side, and the first cylinder spring 520 and the second cylinder spring 510 are arranged on left and right sides of the front side, respectively. The first cylinder damper 540 and the second cylinder damper 530 are positioned between a rear side of the third cylinder spring 500 and a front side of the first cylinder spring 520 and the second cylinder spring 510. Those are symmetry in left/right directions. The cylinder springs are connected to the base 600 with rubber bushings disposed therebetween, respectively.

The tubback 130 and the vibration sensor 191 provided to the tubback 130 will be described in detail, with reference to FIG. 7.

Figure 7:
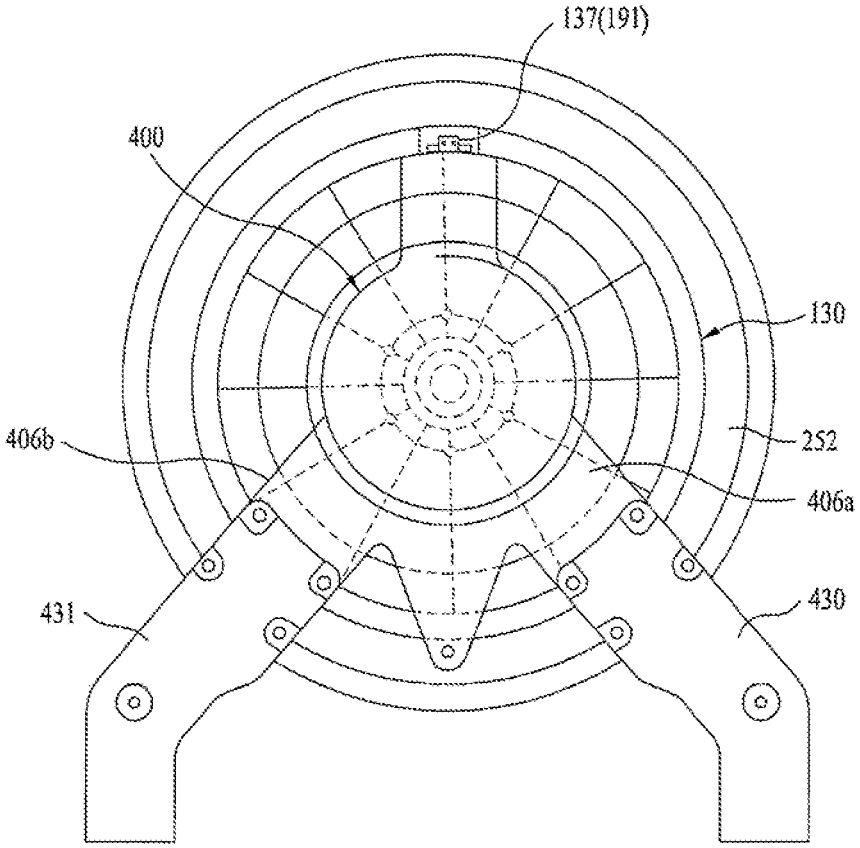
FIG. 7 illustrates a back side view of an assembly of a tubback, a bearing housing, and a motor of a laundry machine in accordance with a preferred embodiment of the present invention.

FIG. 7 illustrates a back side view of an assembly of a tubback, a bearing housing, and a motor of a laundry machine in accordance with a preferred embodiment of the present invention.

The vibration sensor 191 will be described. The vibration sensor 191 senses vibration of the drum. That is, in order to prevent excessive vibration from taking place at the time operation proceeds into spinning, vibration is sensed. For an example, if the excessive vibration takes place, the vibration is sensed for resolving the vibration at an initial progress of the spinning (for an example, in a step of clothes disentangling), rotation of the drum is controlled according to the vibration sensed thus, and, if the vibration is resolved, the operation proceeds to a main spinning.

In the related art, the drum and the tub are rigidly coupled, and the vibration sensor 191 is mounted to the tub. Accordingly, in the related art, the vibration sensor 191 senses the vibration of the drum not directly, but senses vibration of the tub. In the related art, the drum is rotatably supported by the bearing housing 400 fixedly mounted to a rear wall of the tub connected to the rotation shaft of the drum. Accordingly, though the drum can vibrate together with the tub rigidly, there are many cases when the vibration is not such a fashion. For an example, at a lower speed rotation of the drum in the spinning, the vibration can be a rigid mode in which the drum and the tub vibrate rigidly, the vibration can be in a flexible mode in which the drum and the tub is an out of phase state in which vibration of the drum and the tub has a phase difference at the time of high speed rotation of the drum.

However, in the embodiment, since the bearing housing 400 which supports the rotation shaft connected to the drum is connected to the tub with the rear gasket 250, the vibration of the drum can be transmitted to the tubback 130 as it is. Therefore, if the vibration sensor 191 is mounted to the tubback 130, the vibration of the drum can be sensed, more accurately.

A vibration sensor 191 mounting structure can be formed on the tubback 130 for mounting the vibration sensor 191. It is preferable that the vibration sensor 191 is mounted to an outside periphery of the tubback 130 as far as possible. This is because the farther from a vibration center, the greater the amplitude of the vibration. As an example, though the vibration sensor 191 can be mounted to an uppermost edge of the tubback 130, the mounting position is not limited to this. However, in view of easy service, it is preferable that the vibration sensor 191 is positioned at a upper side of the tubback 130.

Moreover, there is a water wall 133 formed at the upper side of the tubback 130 for preventing water from dropping to the motor. The water wall 133 is a rear direction extension from a seating portion 134. The water wall 133 is formed for protecting the motor and the vibration sensor in rear of the tubback 130. That is, water drops once the water is introduced to the laundry machine from an outside of the laundry machine, and the water wall 133 serves as a shielding film for shielding the water being dropping. The mounting structure of the vibration sensor will be described, later.

A structure of the tubback 130 to which the vibration sensor 191 is mounted will be described in detail, with reference to FIGS. 8 to 11.

Figure 8:
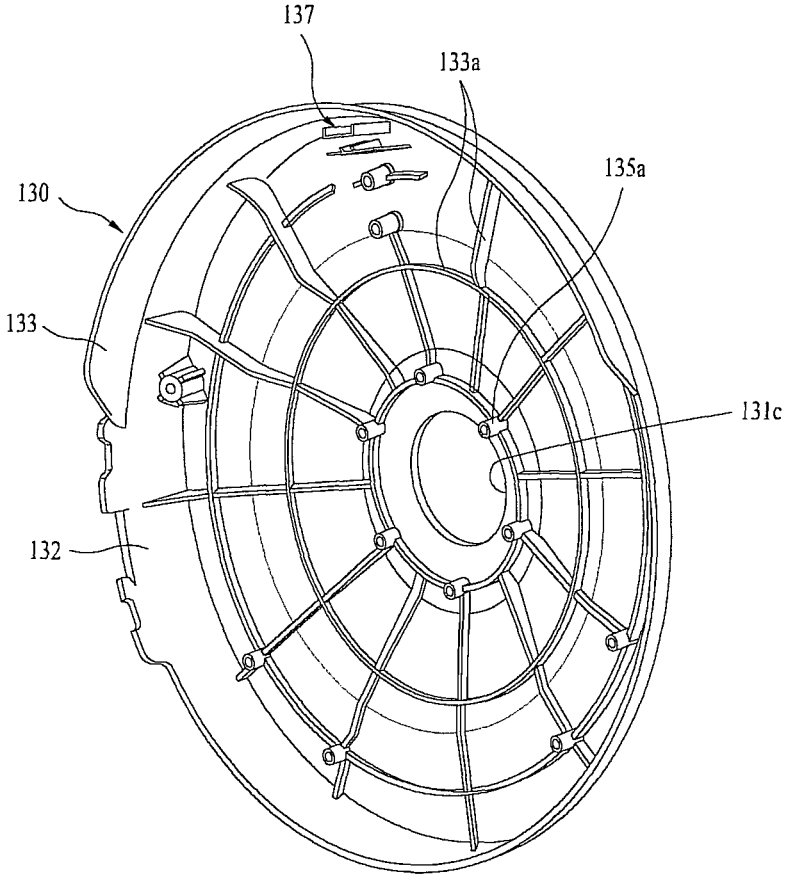
FIG. 8 illustrates a perspective view of a tubback of a laundry machine in accordance with a preferred embodiment of the present invention.
Figure 9:
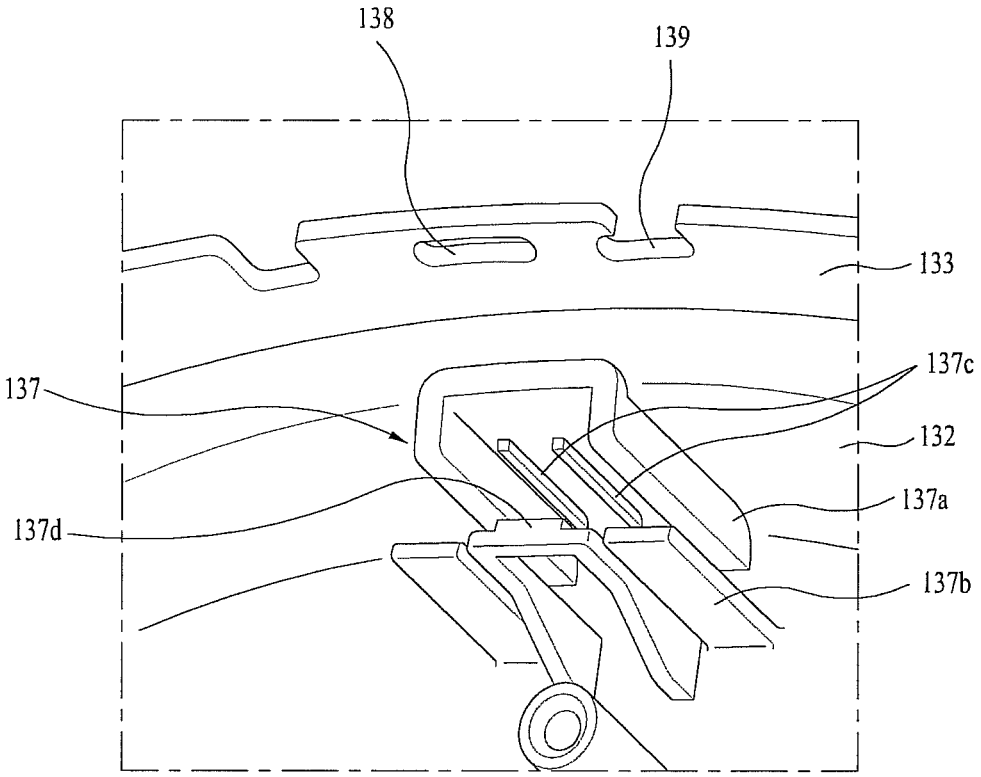
FIG. 9 illustrates a vibration sensor mounting portion at a tubback of a laundry machine in accordance with a preferred embodiment of the present invention.
Figure 10:
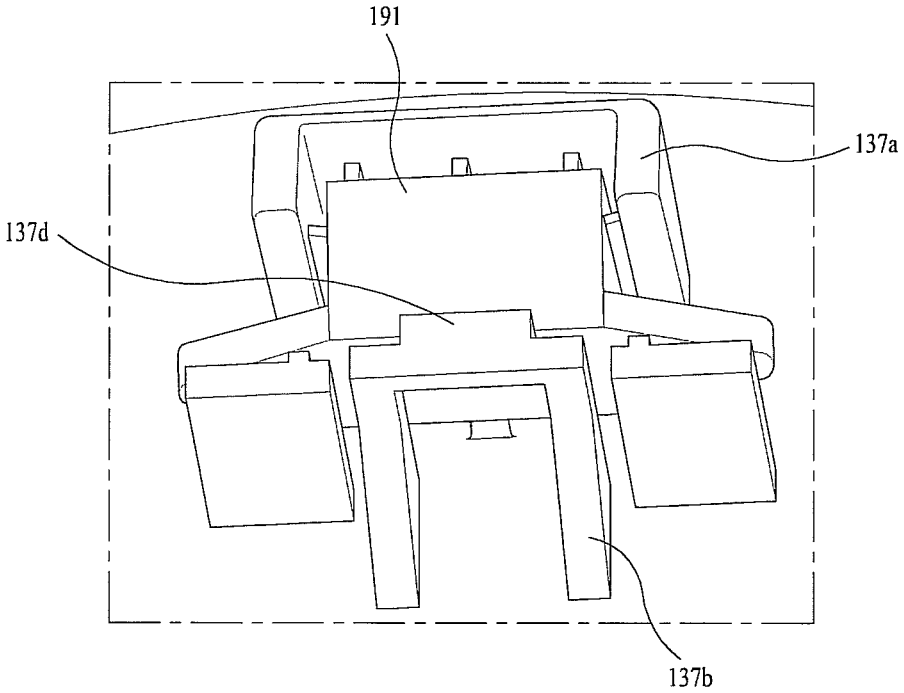
FIG. 10 illustrates a perspective view of a vibration sensor mounted to a vibration sensor mounting portion at a tubback of a laundry machine in accordance with a preferred embodiment of the present invention.
Figure 11:
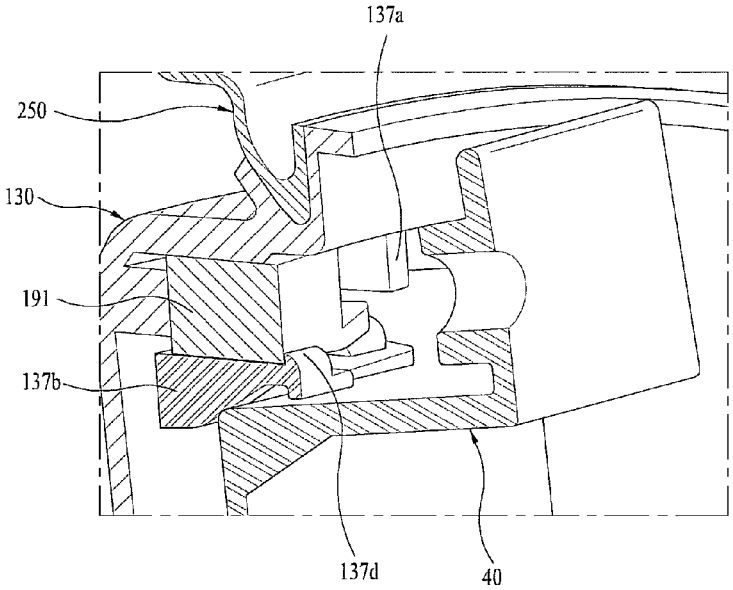
FIG. 11 illustrates a perspective view of a section showing a vibration sensor mounting portion in an assembly of a tubback, a bearing housing, and a motor of a laundry machine in accordance with a preferred embodiment of the present invention.

FIG. 8 illustrates a perspective view of a tubback of a laundry machine in accordance with a preferred embodiment of the present invention, FIG. 9 illustrates a vibration sensor mounting portion at a tubback of a laundry machine in accordance with a preferred embodiment of the present invention, FIG. 10 illustrates a perspective view of a vibration sensor mounted to a vibration sensor mounting portion at a tubback of a laundry machine in accordance with a preferred embodiment of the present invention, and FIG. 11 illustrates a perspective view of a section showing a vibration sensor mounting portion in an assembly of a tubback, a bearing housing, and a motor of a laundry machine in accordance with a preferred embodiment of the present invention.

Referring to FIGS. 8 to 11, the tubback 130 has the vibration sensor mounting portion 137 formed at a predetermined portion thereof. The vibration sensor mounting portion 137 may include a rib 137*a* of an inverted shape cross section projected inward in a radial direction parallel to an inside of the rim portion 132 of the tubback 130 (an inside portion in the radial direction). The vibration sensor 191 can be placed in a space between the ribs 137*a*. In order to support the vibration sensor 191 placed between the ribs 137*a*, a supporting rib 137*b* may be formed.

In addition to this, a plurality of space securing ribs 137*c* are formed on an inside surface of the rib 137*a* for securing a mounting space of the vibration sensor 191 mounted. to the vibration sensor mounting portion 137. And, at an end of the supporting rib 137*b*, there is a holding step 137*d* formed additionally for preventing the vibration sensor 191 from falling off the vibration sensor mounting portion 137.

The vibration sensor 191 is positioned on an inside of the rim portion 132, and the rim portion 132 has the water wall 133 extended therefrom. Accordingly, owing to the position of the vibration sensor 191 and the water wall 133, introduction of the water to the vibration sensor 191 is prevented.

In the meantime, it is preferable that a slot is formed in the water wall 133 over the rib 137*a* for disposing lines connected to the vibration sensor 191. The lines can be placed in the slot 139 and connected to the vibration sensor 191 after the lines are fastened in a circumferential direction along the water wall 133. The lines can be fastened to a hole 138 adjacent to the slot 139 with a cable tie or the like. Wiring becomes very easy because the hole 138 for fastening the lines can be formed in the water wall 133.

In the meantime, the mounting of the vibration sensor 191 to the predetermined portion of the tubback 130 is shown as an example. However, a mounting position of the vibration sensor 191 is not limited to this, but the vibration sensor 191 may be mounted to other portion which vibrates connected to the suspension unit. For an example, vibration sensor 191 can be mounted to the bearing housing 400, the first weight 431, the second weight 430, the first suspension bracket 450, and the second suspension bracket 440, and so on.

Figure 12:
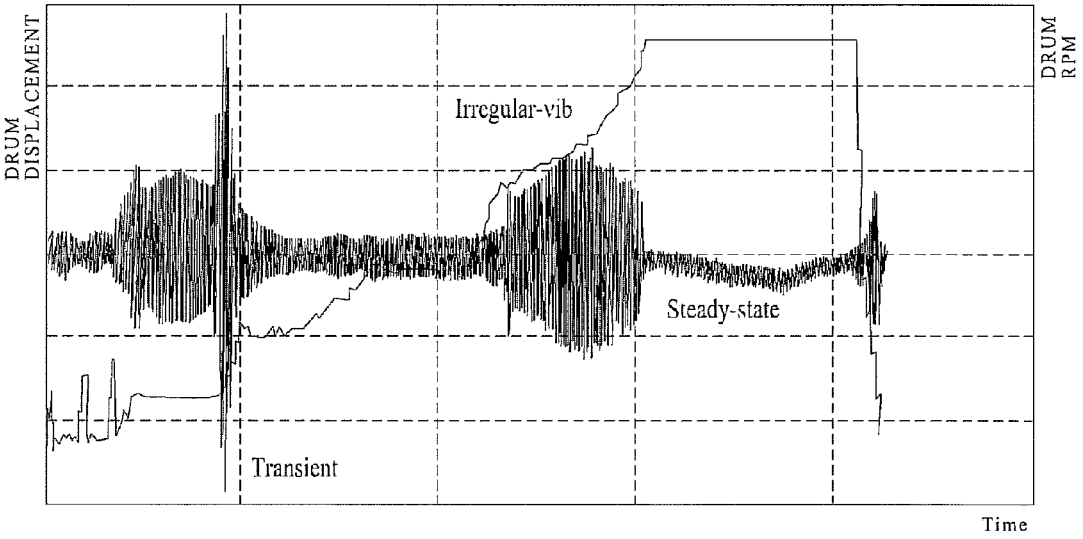
FIG. 12 illustrates a graph showing vibration characteristics of a laundry machine in accordance with a preferred embodiment of the present invention.

In the meantime, a vibration characteristic of the washing machine of the present invention will be reviewed with reference to FIG. 12. As the rotation speed of the drum increases, a region (a transient vibration region) appears, in which transient vibration having great and irregular amplitude takes place. The transient vibration region is a vibration region having irregular and great amplitude before the vibration becomes comparatively steady (steady state vibration), which is in general a vibration characteristic which is fixed as a vibration system (the washing machine) is designed. The washing machine of the embodiment shows the transient vibration at about 200~350 rpm, which is considered to be transient vibration caused by resonance.

If such transient vibration takes place, sensing of the vibration with the vibration sensor is essential, for controlling rotation of the drum according to amplitude of the vibration sensed at the vibration sensor to pass the transient vibration region.

According to the laundry machine of the present invention, since the tub is fixedly secured to the cabinet directly not to make any movement, a diameter of the tub can be made greater, thereby permitting to enlarge volumes of the tub and the drum, substantially.

The supporting of the drum only at one side permits to enlarge the volume of the drum further compared to a system in which the drum is supported by opposite sides, and to improve productivity since a number of components are reduced as much.

Moreover, since the tub is fixedly secured to the cabinet, making not only the tub to shake in a case vibration or an impact is applied to the tub which is assembled as one unit with the cabinet, rigidity of the tub increases since weight of the cabinet is added to the tub, and an overall vibration characteristic of the drum type washing machine is improved.

The invention claimed is:

1. A laundry machine, comprising:

a tub that holds washing water;

a drum provided in the tub to hold laundry;

a rotational shaft connected to a rear surface of the drum;

a tub back which forms a rear side of the tub and through which the rotational shaft passes;

a bearing housing that supports the rotational shaft;

a suspension that buffers and supports the bearing housing; and a vibration sensor that senses vibration of a structure supported by the suspension, wherein the tub back includes a rim portion formed at an outside circumferential surface thereof, and wherein a vibration sensor mounting portion is formed at an inside of the rim portion to which the vibration sensor is mounted.

2. The laundry machine as claimed in claim 1, wherein the tub back is fastened to the rear side of the tub using a rear gasket.

3. The laundry machine as claimed in claim 1, wherein the rim portion includes a water wall that protects from an upper side of the vibration sensor mounting portion.

4. The laundry machine as claimed in claim 1, wherein the vibration sensor mounting portion includes:

a rib that supports an upper side of the vibration sensor; and a supporting rib that supports an underside of the vibration sensor.

5. The laundry machine as claimed in claim 4, wherein the supporting rib includes a holding step that prevents the vibration sensor from falling off the vibration sensor mounting portion.

6. The laundry machine as claimed in claim 4, wherein the vibration sensor mounting includes a plurality of space securing ribs on an inside surface of the rib that secures a mounting space of the vibration sensor.

7. The laundry machine as claimed in claim 4, wherein the vibration sensor mounting portion is disposed at an upper side of the tub back.

8. The laundry machine as claimed in claim 4, wherein the rib has an inverted shape cross section that projects inward in a radial direction parallel to an inside of the rim portion.

* * * * *